US007743827B2

(12) United States Patent
Kadomoto et al.

(10) Patent No.: US 7,743,827 B2
(45) Date of Patent: Jun. 29, 2010

(54) REMOTE OPERATION WIRE LINE CORE SAMPLING DEVICE

(75) Inventors: Yukio Kadomoto, Tokyo (JP); Isao Yamanaka, Tokyo (JP); Hiroshi Tanaka, Yokohama (JP); Takahiko Tsuchiya, Fukuoka (JP)

(73) Assignees: Mitsui Engineering & Shipbuilding Co., Ltd., Tokyo (JP); K. Maikai Co., Ltd., Tokyo (JP); Toho Chikakoki Co., Ltd., Fukuoka (JP)

( * ) Notice: Subject to any disclaimer, the term of this patent is extended or adjusted under 35 U.S.C. 154(b) by 0 days.

(21) Appl. No.: 10/563,366

(22) PCT Filed: Sep. 1, 2004

(86) PCT No.: PCT/JP2004/013001

§ 371 (c)(1),
(2), (4) Date: Mar. 20, 2006

(87) PCT Pub. No.: WO2005/024174

PCT Pub. Date: Mar. 17, 2005

(65) Prior Publication Data

US 2006/0169493 A1 Aug. 3, 2006

(30) Foreign Application Priority Data

Sep. 5, 2003 (JP) ..... 2003-313972

(51) Int. Cl.
*E21B 49/02* (2006.01)
*E21B 25/02* (2006.01)

(52) U.S. Cl. ..... 166/246; 166/214; 166/240; 166/245; 166/249; 166/250

(58) Field of Classification Search ..... 175/240, 175/245, 246, 247, 250, 214, 215, 249; 73/864.45
See application file for complete search history.

(56) References Cited

U.S. PATENT DOCUMENTS

| | | | | |
|---|---|---|---|---|
| 1,499,024 | A * | 6/1924 | Miller | 175/214 |
| 3,120,282 | A * | 2/1964 | Pickard | 175/214 |
| 6,105,692 | A * | 8/2000 | Clarke et al. | 175/214 |

FOREIGN PATENT DOCUMENTS

| | | |
|---|---|---|
| JP | 11-256974 | 9/1999 |
| JP | 2002-266585 | 9/2002 |
| JP | 2002-285780 | 10/2002 |

OTHER PUBLICATIONS

International Preliminary Report on Patentability issued Jun. 20, 2006, in International (PCT) Application No. PCT/JP2004/013001 of which the present application No. 10/563,366 is the U.S. National Stage.

* cited by examiner

*Primary Examiner*—David J Bagnell
*Assistant Examiner*—Brad Harcourt
(74) *Attorney, Agent, or Firm*—Wenderoth, Lind & Ponack, L.L.P.

(57) ABSTRACT

Remote operation wire line core sampling device capable of increasing efficiency of working and maintaining a wall of a hole using a stabilized sea-bottom core drill at a sea-bottom, and adopting a wire line system. The device includes a drill rod held by a chuck of the sea-bottom core drill, a wire line core barrel having, at a tip thereof, a bit for annularly drilling into ground, an inner tube assembly detachably incorporated in the wire line core barrel, and an over-shot assembly having a function for engagement thereof with a spear head part at a top end of an inner tube assembly. The device also includes a water swivel in which water supply ports are formed at upper and lower parts thereof, a modified built-in type over-shot assembly is formed at upper and lower parts thereof, and a modified built-in type over-shot assembly is incorporated therein to reside at an intermediate part thereof.

5 Claims, 6 Drawing Sheets

REMOTE OPERATION WIRE LINE CORE SAMPLING DEVICE

BACKGROUND ART

The present invention relates to a remote operation wire line core sampling device equipped with a core barrel for investigating bed rocks and deposits at a sea-bottom by using a stabilized sea-bottom core drill.

In conventional sea bed sampling, there are two methods. In other words, one is a method for collecting samples on a sea-bottom surface by using a dredge that linearly collects samples from the sea-bottom surface, or a grab that collects samples spread over a given width from a given place on the sea bottom surface. The other is a method for collecting samples at a given depth from the sea bottom surface. In a method generally adopted when taking samples at a depth from the sea-bottom surface, a tool called a corer is used, and a sampling tube called a core barrel is pierced through a bottom material of the sea bed to take the samples. While the corer, which utilizes its own gravity and initial piercing velocity, can pierce ground by ten and several meters at a maximum when the ground is soft, its capacity is substantially reduced in case of a sand bed or a somewhat hard stratum, and sample taking is impossible when the bottom material is rock.

FIG. 6 shows a conventional over-shot assembly for underground use (for horizontal boring). A lifting dog 9 is biased in a closing direction by a lifting dog spring 10. The over-shot assembly has a piston 33 in contact with an inner wall of a drill rod and is pushed in toward a hole bottom by a supply water pressure from above. At this time, a valve sleeve 31 is set by using man power in such a way as shown on the right-hand side of FIG. 6 against force of a valve spring 32, and an outlet of a water passage 34. That is, an opening adjacent to an upper side of the valve sleeve 31 is closed, whereby an increase in pressure is to be expected. At this time, a lower end of the valve sleeve 31 is at a shoulder portion 9-1 of a lifting dog handle 9-2. When the lifting dog 9 is engaged with a spear head 25 of an inner tube assembly, a forward end of the lifting dog 9 is opened, and the lifting dog handle 9-2 is diminished, so the valve sleeve 31 is caused to slide to a lowermost position by the force of the valve spring 32 as shown on the left-hand side of FIG. 6. At this time, the outlet of the water passage 34, that is, an opening adjacent to the left-hand side of the valve sleeve 31 is opened, so a reduction in supply water pressure is to be observed, and it is possible to ascertain that the lifting dog 9 has been fit-engaged with the spear head 25 of the inner tube assembly. At this time, the lifting dog handle 9-2 is situated at a lifting dog handle window formed in the valve sleeve 31. When the forward end of the lifting dog 9 is to be opened to detach the inner tube assembly, the opening operation is performed by holding the lifting dog handle 9-2 by hand.

FIG. 7 shows another conventional water swivel assembly for underground use. A spindle 35 is screw-connected to an uppermost portion of a drill rod and adapted to rotate, is isolated from a non-rotating portion by a ball bearing 36, and watertightness is maintained between a rotating portion and a non-rotating portion by a packing set 37. A water supply hose 43 is attached to a pipe bushing 38, and a wire rope passes through a small hole 41 at a top, and extends to an interior of a tube while maintaining watertightness by use of a wire rope packing 39. A wire rope is wound up by a winch (not shown) by way of a rope sheave 40.

As compared with an ordinary corer, which pierces through a bottom material solely by virtue of gravity and piercing velocity, a stabilized sea-bottom core drill, which has a rotary device and a feeding device and which can rotatingly pierce the bottom material while performing digging through rotation of a core bit at the forward end, is capable of sample collection regardless of hardness of the bottom material, and can exert a remarkable capacity in sea bottom sampling. On the other hand, in the stabilized sea-bottom core drill, continuous core sampling cannot be effected without letting in and out a core barrel a large number of times. Therefore, it was required to repeat retrieval and reinsertion of the core barrel and a drill rod each time. An example of retrieval is performing a next stroke, and reinsertion means performing of a reverse stroke. The deeper a digging place becomes, the more frequent time of retrieval and reinsertion become in geometrical progression. Thus, due to difficulty in operating a ship connected by a dither cable and limitations in operation time, there was a limit to depth allowing core sampling through operation of the stabilized sea-bottom core drill. Operational procedures are in the following order: drill rod pulling out; drill rod unscrewing; chuck-opening/drill-head-raising; rod movement/accommodation through manipulator; drill head lowering; chuck closing; and return.

Further, in the conventional core sampling, each time sampling collection is effected according to an effective length of a core barrel, a core barrel and the drill rod are inserted into and pulled out of the boring hole, so a hole wall of the boring hole may collapse, thereby making it impossible for a newly inserted core barrel to reach the hole bottom. Debris of the hole wall collapsed would flow down to the hole bottom to mix into the sample to be collected, resulting in deterioration in sample quality, which was rather difficult to cope with.

In the case of wire line core sampling performed on the ground, a core barrel outer tube with a core bit mounted to a forward end thereof and a drill rod are not retrieved but solely an inner tube assembly containing a sample is retrieved on the ground through introduction of an over-shot and operation of a wire rope, with a new inner tube assembly being dropped into the drill rod to be automatically attached to the core barrel at the forward end. If this system could be applied to a stabilized sea bottom core drill, operation of retrieving/reinserting the drill rod would have been omitted and the above-mentioned problem of hole wall collapse must have been solved. Thus, application of this system has not realized and has been ended in a hope.

However, wire line core sampling performed on the ground has needed operation to be conducted by man power, such as introduction of an inner tube assembly and separation of the over-shot and the inner tube assembly. Thus, adoption of the wire line system to a stabilized sea-bottom core drill used at the sea-bottom has not been made so far.

As another conventionally known technique, an ordinary wire line sampler recovery device is disclosed (Patent Document 1). Further, there are disclosed a sliding tube containing an expandable latch equipped with a latch spring, an engagement member (spear head) arranged at an upper end thereof, and an over-shot assembly grasping this engagement member, and the like. (Patent Document 2).

[Patent Document 1] JP 07-11860 A (FIG. 3)

[Patent Document 2] JP 2903350 B (FIG. 4)

SUMMARY OF THE INVENTION

It is an object of the present invention to modify a conventional sea-bottom core drill as described above and an instrument for wire line core sampling conducted on the ground, and to apply a wire line system to a stabilized sea-bottom core drill for use at the sea bottom, thereby achieving an improvement in terms of operational efficiency and an improvement in core sample quality through hole wall preservation.

For remote operation of a wire line core sampling system, it is necessary to provide, in addition to the performance of a conventional stabilized sea-bottom core drill, a performance allowing the following operations, which are conducted on the ground by man power:

Introduction and recovery of an over-shot assembly; and introduction and recovery of an inner tube assembly.

Further, from the viewpoint of the provision of equipment for introduction/retrieval from onboard a ship and a requisite stability with respect to external forces applied thereto at the sea bottom, a height of a stabilized sea-bottom core drill is required to as small as possible.

According to the present invention, a stabilized sea-bottom core drill is used, and an instrument for wire line core sampling conducted on the ground is modified such that a wire line system can be adopted for sea-bottom use, thereby achieving an improvement in terms of operational efficiency and hole wall preservation.

It is an object of the present invention to provide a remote operation wire line core sampling device which easily allows replacement of the core sampler under a deep sea.

It is an object of the present invention to provide a remote operation wire line core sampling device for the first time which requires no operation by man power.

The above objects of the present invention can be achieved by the following composition.

That is, the present invention provides a composition of a remote operation wire line core sampling device including: a water swivel assembly; a drill rod coaxially connected to the water swivel assembly; a wire line core barrel coaxially connected to a lower end of the drill rod and having at a forward end a bit for annularly digging the ground; an inner tube assembly detachably set in the wire line core barrel; and an over-shot assembly endowed with a function of grasping an upper end portion of the inner tube assembly, characterized in that the water swivel assembly has water supply ports at an upper position and a lower position thereof, and accommodates the over-shot assembly at an intermediate position, and a pressurized fluid is supplied from an upper water supply port to make it possible to lower the over-shot assembly to the inner tube through the drill rod.

Further, the above objects can be achieved by the following composition. That is, the present invention provides a remote operation wire line core sampling device including: water supply ports are provided in upper and lower parts, and a water swivel with an over-shot with a piston residing therein is arranged therebetween. Drilling heat generated through rotational digging by a core bit arranged at a forward end is removed by inflow of a fluid from a lower water supply port. At the same time, digging mud (slime) is washed away from a hole bottom. Upon completion of one sampling, an over-shot assembly is lowered to a spear head portion at an upper end of an inner tube assembly at the hole bottom through inflow of a fluid from an upper water supply port, and is engaged with a spear head in the upper portion of the inner tube assembly by a lifting dog. The inner tube assembly is solely raised for replacement to allow an unused inner tube assembly to descend again.

Further, the above objects can be achieved by the following composition. That is, the present invention provides a remote operation wire line core sampling device including: a drill head portion of a sea-bottom core drill; a chuck rotatably mounted to the drill head portion; a drill rod grasped by the chuck; a wire line core barrel connected to the drill rod and having at a forward end a bit for annularly digging the ground; an inner tube assembly detachably provided inside a wire line core barrel; and an over-shot assembly endowed with a function of grasping an upper end portion of the inner tube assembly and raising the inner tube assembly through the drill rod, characterized in that the remote operation wire line core sampling device has a mechanism by means of which, with the drill rod being retained in a hole, the drill head is lifted upwards to extract the inner tube assembly out of the drill rod.

With the above construction, the remote operation wire line core sampling device of the present invention can attain the following effects.

There has been devised a novel water swivel in which two water supply ports are provided. From a lower water supply port, there is supplied boring water to be used for bit cooling and removal of slime from a hole bottom during boring. A novel over-shot assembly with a piston resides in the water swivel. When pressure water of a boring pump is supplied from the upper water supply port, it descends within the drill rod to reach the core barrel upper portion at the hole bottom, and the spear head at the upper end of the inner tube assembly is grasped by the lifting dog.

When a drill rod of the same effective length as the core sample collection length of the core barrel is used, and a core barrel and an inner tube assembly that are longer than the drill rod are inserted or retrieved, it is necessary to temporarily increase the retrieval stroke thereof, so there is provided a lift mechanism by means of which the drill head of the sea-bottom core drill is raised.

At a time of digging with the drill rod, a rotational torque reaction force is exerted, so the machine height is adjusted such that the core bit at the forward end of the initial core barrel comes into contact with the sea bottom surface after the lift of the drill head has been restored.

In performing core sampling with the stabilized sea-bottom core drill, the bottom material is cut annularly by rotating and feeding the bit at the forward end, thereby accommodating the core sample remaining within in the core barrel. In this process, to cool the core bit constituting the cutter heated by drilling and to wash away the slime (drilling mud) resulting from the drilling, boring water is supplied to the hole bottom from a digging pump provided in the stabilized sea bottom core drill main body through the water swivel connected to a delivery hose, utilizing the interior of the drill rod, which is a hollow tube. The water swivel is a rotatable instrument provided with a packing and a rotary bearing to supply water from the hose to the interior of the rotating drill rod.

When digging has been performed by the sampling length of the core barrel, the core barrel is replaced. In conventional boring, the drill rod is retrieved each time the core barrel is to be replaced, replacing the core barrel at the forward end. In the novel core sampling, a wire line core barrel is used. Solely the inner tube assembly containing the core sample is extracted by a wire rope without retrieving the core barrel outer tube with the bit attached thereto and the drill rod, and is replaced with an unused inner tube assembly.

In the remote operation wire line core sampling device of the present invention, when the inner tube of the inner tube assembly is filled with the sample, the overshot is lowered by water pressure while keeping the core barrel outer tube and the drill rod as they are, and the inner tube assembly containing the core sample is solely extracted and retrieved, and a novel unused inner tube assembly is dropped to the hole bottom and connected to a novel drill rod to resume core sampling. Thus, it is possible to omit the operations of retrieving and reconnecting the drill rod.

DETAILED DESCRIPTION OF THE INVENTION

In the following, an embodiment of the present invention will be described with reference to the drawings.

Figure 1:
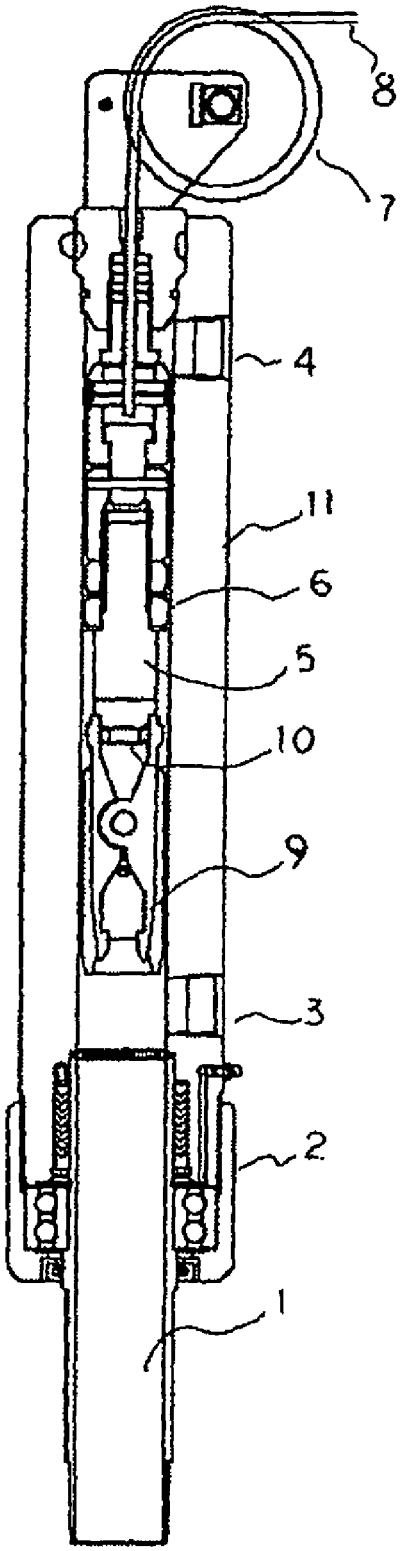
FIG. 1 is a main portion schematic sectional view of a water swivel assembly with a built-in over-shot for use in a stabilized sea-bottom core drill according to the present invention.
Figure 2A:
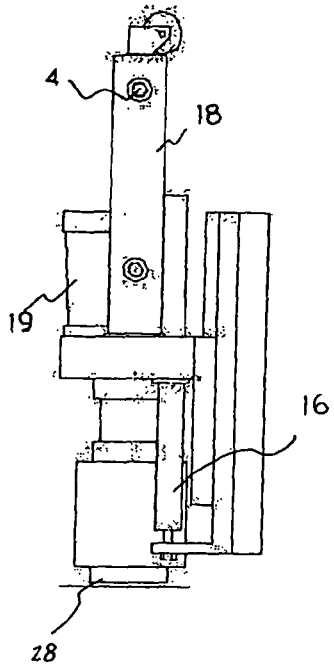
FIGS. 2A and 2B are an explanatory view of a drill head lift device for use in the stabilized sea-bottom core drill of the present invention.
Figure 2B:
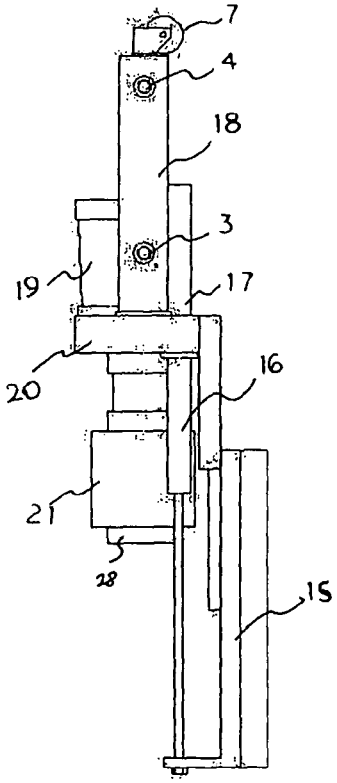
Figure 3:
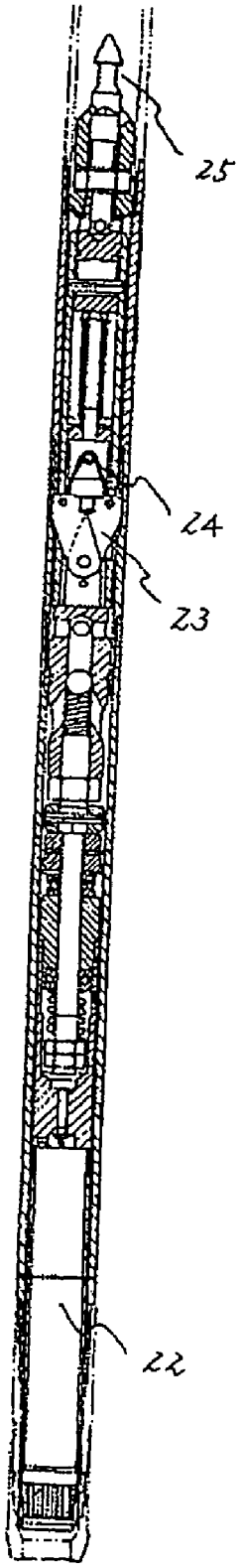
FIG. 3 is a general view of a wire line core barrel as assembled for use in the stabilized sea-bottom core drill of the present invention.
Figure 4:
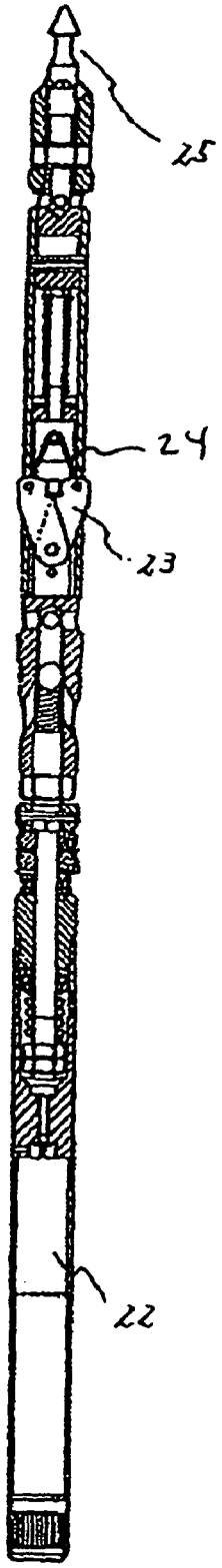
FIG. 4 is an explanatory view of an inner tube assembly for use in the stabilized sea-bottom core drill of the present invention.
Figure 5:
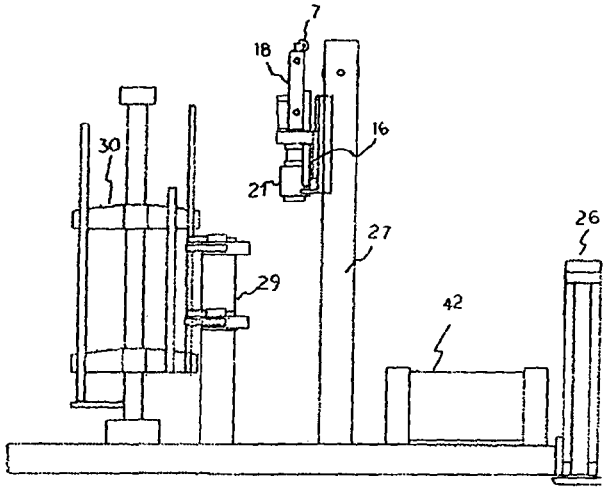
FIG. 5 is a general view of the stabilized sea-bottom core drill of the present invention as installed.
Figure 6:
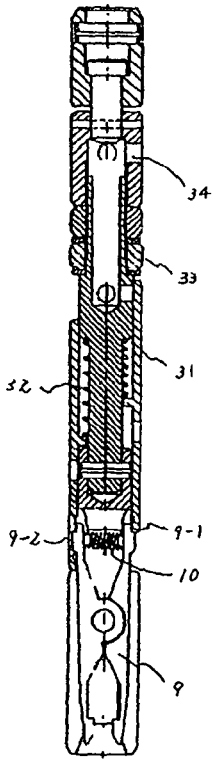
FIG.6 (PRIOR ART)
FIG. 6 is an explanatory view of a conventional underground over-shot assembly for use in wire line core sampling conducted on the ground.
Figure 7:
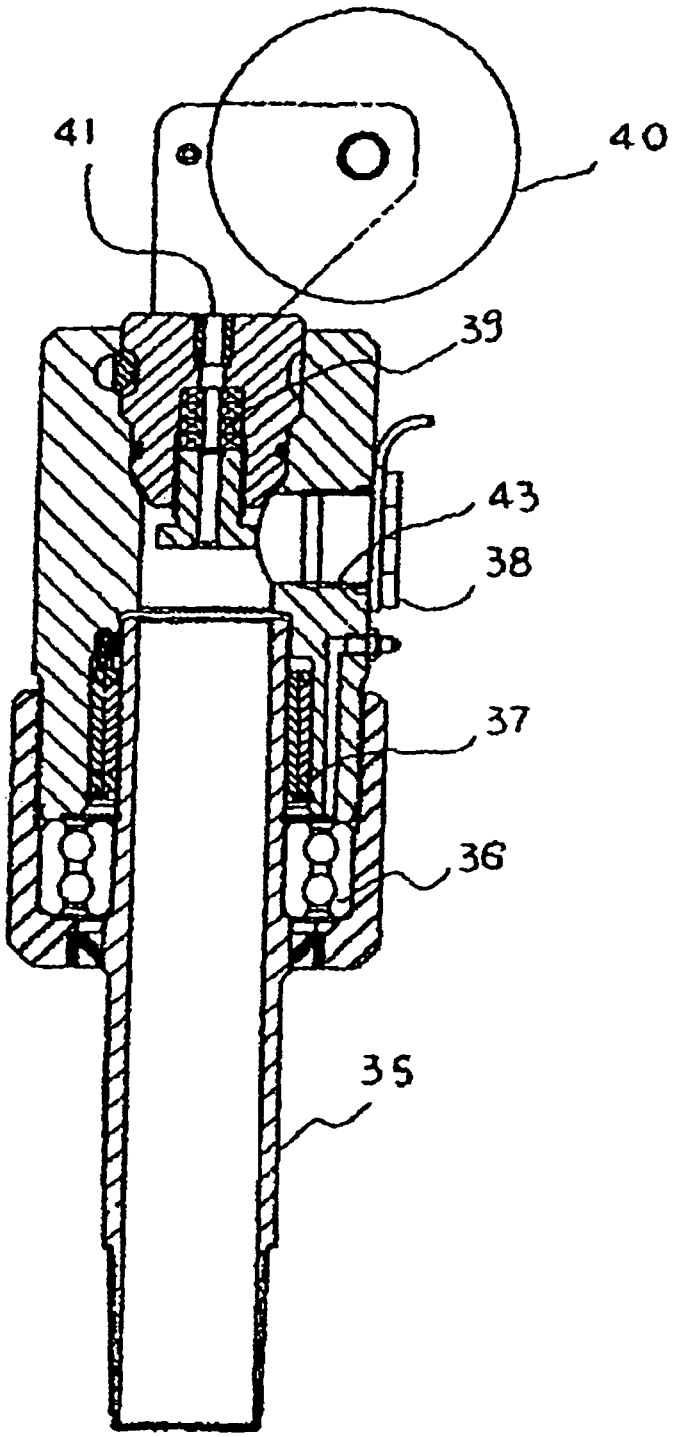
FIG. 7 is an explanatory view of a conventional underground water swivel assembly for use in wire line core sampling conducted on the ground.

FIG. 1 is an explanatory view of a water swivel assembly with a built-in over-shot for use in a remote operation wire line core sampling device of the present invention. FIGS. 2A and 2B are schematic views for illustrating operation of a drill head lift device for use in the device of the present invention. FIG. 3 is a general view of a wire line core barrel as assembled. FIG. 4 shows an inner tube assembly thereof, which is raised by the over-shot. FIG. 5 is a general view of a stabilized sea-bottom core drill. FIG. 6 shows an underground over-shot for use in conventional wire line sampling conducted on the ground. FIG. 7 shows an underground water swivel for use in conventional wire line sampling conducted on the ground.

For wire line core sampling conducted on the ground, instruments for vertical boring and instruments for horizontal boring are produced of which the latter are generally referred to as underground instruments. In an underground instrument, dropping to a hole bottom by gravity cannot be expected, so an inner tube assembly with a piston and an over-shot are sent to the hole bottom by utilizing pressure and an amount of water discharged from a boring pump.

In vertical wire line core sampling conducted on the ground, a wire line core barrel as shown in FIG. 3 is used, and a drill rod is connected thereto, performing digging using a water swivel (not shown). In the drill rod (not shown), when extracting the inner tube assembly, a water swivel 18 is removed, and a thin wire rope is attached to an ordinary over-shot adapted to fall by its own weight, dropping it to a spear head portion at an upper end of the inner tube assembly at the hole bottom. After confirming its arrival at the hole bottom from slack in the wire rope, the wire rope is taken up by a winch (not shown), thereby raising the inner tube assembly. On the ground, a lifting dog 9 is removed by hand while retaining the inner tube assembly by man power, and the inner tube assembly is stored.

In underground wire line sampling, the inner tube assembly itself is equipped with a piston, and is pushed down to the hole bottom by water pressure.

In the inner tube assembly shown in FIG. 4, a latch 23 is opened by a latch spring 24 to enter a recess in a core barrel outer tube to be fixed in position therein. When an inner tube 22 is filled with a sample, an overshot 5 (see FIG. 1) to which a wire rope 8 is attached is lowered, and the lifting dog 9 of the overshot grabs a spear head 25. A winch (not shown) is operated to raise the inner tube assembly by way of a sheave 7 (see FIG. 1).

In the present invention, the core barrel assembly as shown in FIGS. 3 and 4 are used as it is, and a water swivel with a built-in over-shot residing therein is newly installed, making it possible to perform wire line core sampling through remote operation.

FIG. 1 shows a water swivel assembly with a built-in over-shot residing therein for use in a remote operation wire line core sampling device according to the present invention.

A spindle 1 is mounted to a rotary spindle of a drill head 28 in a watertight fashion by a screw or the like. A bearing housing 2 extends along a length of a housing 11, which has in its lower part a digging water supply port 3 and in its upper part an over-shot water supply port 4, with a built-in type over-shot assembly 5 being accommodated in an intermediate hollow part therebetween. At a time of digging, boring water is supplied through the digging water supply port 3. When, after completion of digging, the inner tube assembly is to be extracted, water is supplied through the over-shot water supply port 4 to lower a piston 6 of the built-in type over-shot assembly 5, sending the over-shot assembly down to a hole bottom. On a digging water supply side, there is provided a check valve (not shown), forming a structure not allowing over-shot supply water to flow out to the digging water supply side. The wire rope 8 is connected to a top portion of the built-in type over-shot assembly 5, and is connected to a winch (not shown) by way of the sheave 7.

FIGS. 2A and 2B show a drill head lift device for use in the device of the present invention.

The drill head 28 is composed of a frame 15, a lift cylinder 16, a guide 17, an oil motor 19 for rotation, a gear case 20, and a hydraulic chuck 21, and a water swivel 18 with a built-in over-shot is mounted thereto.

FIG. 2A is a diagram showing a state during a digging operation, and FIG. 2B is a diagram showing a state in which a drill head rotating portion has been raised by the lift cylinder 16. The lift cylinder 16 is used when inserting or retrieving a core barrel and an inner tube that are longer than a drill rod. A lift height is determined to be a difference in length between the drill rod and the core barrel. A machine height is determined such that a forward end bit is at a digging position after the lift cylinder has been restored to an initial position.

FIG. 5 shows a stabilized sea-bottom core drill. Reference numeral 26 indicates an attitude control jack, which is suspended from a ship, adjusting a machine attitude after it has reached a sea bottom. Over a slide base of a drill mast 27, the drill head 28 is caused to move up and down by a feeding device (not shown). A manipulator 29 is a machine hand for moving a digging instrument, and the like, between a pipe rack 30 and a drill head digging core position. The pipe rack 30 specifies a rack position for supply or reception to or from the manipulator 29. A utility unit 42 includes an electric hydraulic device, a computer, and the like.

Wire line core sampling by using the stabilized sea-bottom core drill for use in the present invention is conducted in the following order.

The manipulator 29 extracts the wire line core barrel from the pipe rack 30, and moves it to the digging core. In this process, the drill head 28 is moved to the uppermost position of the drill mast 27 by the feeding device (not shown), and is further lifted by the drill head lift device to secure an insertion space.

The drill head 28 is lowered to a core barrel chuck position by the lift cylinder 16, a chuck is closed, and the manipulator retracts. Then, the lift descends, and the core barrel forward end reaches a sea bottom surface. Thereafter, supply of boring water and rotation are started to perform digging with the core barrel by an effective length.

Water supply through the over-shot water supply port 4 is started, and the built-in type over-shot assembly 5 is sent down to the hole bottom. Its arrival at the hole bottom is detected from a reduction in a water supply pressure. At this time, the drill rod is retained in the hole.

Next, with a drill rod position remaining the same, as shown in FIG. 2B, the drill head 28 is moved beyond an uppermost portion of the drill mast 27 by the lift cylinder 16 to secure a retrieval space for extracting the inner tube assembly by the over-shot assembly. The winch (not shown) is driven to suspend the built-in type over-shot assembly 5 up to a predetermined position by use of the wire rope 8. After retaining the inner tube assembly by a main hand of the manipulator 29, the lifting dog 9 is opened by a sub hand thereof, and, by taking up the wire rope 8, the built-in type over-shot assembly 5 is further raised to an accommodating position inside the water swivel assembly 18. The manipulator 29 stores a used inner tube assembly in the pipe rack 30, and extracts an unused inner tube assembly and moves it to the digging core position, dropping it into the core barrel or the drill rod.

The manipulator 29 extracts a new drill rod from the pipe rack 30, and moves it to the digging core, retracting after lowering of the drill head and closing of the chuck.

After the drill rod is connected to the core barrel upper portion by a screw, the drill head starts boring water supply and rotation to perform digging.

After completion of the digging, this procedure returns to a step of retrieving the inner tube assembly by the built-in type over-shot assembly 5, and digging is repeatedly performed.

When digging has been effected to a predetermined depth, a screw of the drill rod used for digging is successively unfastened while retaining the drill rod in the boring hole by the drill head 28 and a holder (not shown) so as to prevent it from falling to the hole bottom, and is accommodated in the pipe rack 30 by the manipulator 29.

The invention of the remote operation wire line core sampling device has made it possible to perform wire line core sampling in an environment where operation by man power has been impossible, such as under water. This helps to omit retrieval and reinsertion time for the drill rod regardless of a digging depth. Further, after recovery of the core sample, it has become possible to quickly and easily perform a next digging operation successively from that digging depth. Further, since a core sample can be easily recovered, it is possible to determine a length of the core barrel and the drill rod without taking into consideration requisite time and effort for their retrieval and re-insertion. Their length can be minimized to thereby achieve a reduction in size of the core sampling device as a whole.

Further, it is possible to prevent a hole wall from collapsing due to retrieval and reinsertion each time digging is performed by a core barrel effective length, thus realizing a safe boring operation.

Due to the above effects, efficiency in a boring operation is enhanced, and there is to be expected a contribution to an improvement in a quality of a stabilized sea-bottom core drill, in which limitations in terms of time are to be taken into consideration.

The present invention paves the way to remote operation and operational automation of wire line core sampling, and contributes to labor saving and automation in general geological surveying.

INDUSTRIAL APPLICABILITY

The remote operation wire line core sampling device of the present invention is applicable to a core sampling device operated automatically or semiautomatically when performing core sampling and the like, in resources surveys and scientific research under the deep sea, and allows replacement of an inner tube assembly connected to a stabilized sea-bottom core drill to accommodate a core sample efficiently and in a short time.

The invention claimed is:

1. A remote operation wire line core sampling device comprising:

a water swivel assembly;

a drill rod coaxially connected to said water swivel assembly;

a wire line core barrel coaxially connected to a lower end of said drill rod and having at a forward end a bit for annularly digging ground;

an inner tube assembly detachably set in said wire line core barrel; and an over-shot assembly for grasping an upper end portion of said inner tube assembly, wherein said water swivel assembly includes an upper water input port at an upper position of said water swivel assembly, said upper water input port adapted to allow pressurized fluid into said water swivel assembly, and a lower water input port at a lower position of said water swivel assembly, said lower water input port adapted to allow pressurized fluid into said water swivel assembly, and wherein said water swivel assembly accommodates the whole of said over-shot assembly at an intermediate position thereof between said upper water input port and said lower water input port such that the pressurized fluid is supplied from said upper water input port to lower said over-shot assembly through said drill rod to an upper end of said inner tube assembly.

2. The remote operation wire line core sampling device according to claim 1, further comprising:

a drill head portion of a sea-bottom core drill, said drill head portion having a frame slideably mounted to a mast;

a chuck rotatably mounted to said drill head portion for grasping said drill rod; and a mechanism for lifting said drill head portion along said frame, while said drill rod is retained in a hole, for extracting said inner tube assembly from said drill rod, wherein the over-shot assembly is for raising said inner tube assembly through said drill rod.

3. The remote operation wire line core sampling device according to claim 1, wherein said upper water input port and said lower water input port are located in a side wall of said water swivel assembly.

4. The remote operation wire line core sampling device according to claim 1, wherein said water swivel assembly has a hollow region passing therein in a first direction; and said upper water input port and said lower water input port are positioned in a second direction that is perpendicular to the first direction.

5. The remote operation wire line core sampling device according to claim 1, wherein said water swivel assembly accommodates the whole of said over-shot assembly at an intermediate position thereof exactly between said upper water input port and said lower water input port.

* * * * *